US006427832B1

(12) United States Patent
Ali et al.

(10) Patent No.: US 6,427,832 B1
(45) Date of Patent: Aug. 6, 2002

(54) DISPLAY PACKAGE

(76) Inventors: Terry Ali; Chris Ali, both of 611 Yellow Springs-Fairfield Rd., Fairborn, OH (US) 45324

( * ) Notice: Subject to any disclaimer, the term of this patent is extended or adjusted under 35 U.S.C. 154(b) by 7 days.

(21) Appl. No.: 09/748,475

(22) Filed: Dec. 26, 2000

(51) Int. Cl.[7] ..... B65D 85/02

(52) U.S. Cl. ..... 206/303; 206/461; 206/467; 206/471

(58) Field of Search ..... 206/303, 461, 206/467, 471; 220/4.21, 4.24, 4.25; 229/406, 407

(56) References Cited

U.S. PATENT DOCUMENTS

| | | | | | |
|---|---|---|---|---|---|
| 2,755,954 | A | * | 7/1956 | Antritter | 202/4.21 |
| 3,259,231 | A | * | 7/1966 | Romanowski | 206/303 |
| 3,260,360 | A | * | 7/1966 | Davis | 206/349 |
| 3,596,822 | A | * | 8/1971 | Holley | 206/303 |
| 3,938,726 | A | * | 2/1976 | Holden et al. | 229/103.11 |
| 4,120,398 | A | * | 10/1978 | Braddon, Sr. | 206/303 |
| 4,469,226 | A | | 9/1984 | Matney | 206/470 |
| 4,739,883 | A | | 4/1988 | Mohs et al. | 206/470 |
| 5,036,980 | A | * | 8/1991 | Vigue et al. | 206/515 |
| 5,649,624 | A | | 7/1997 | Seaton | 206/461 |
| 6,059,106 | A | | 5/2000 | Baker et al. | 206/361 |

* cited by examiner

*Primary Examiner*—David T. Fidei
(74) *Attorney, Agent, or Firm*—R. William Graham

(57) ABSTRACT

A reclosable display package of thin flexible thermoformed plastic material for packaging and displaying an article therein, the reclosable display package includes a first package portion having a base with a retaining surface and a peripheral edge, a wall surface connected at a bottom edge extending generally perpendicular to the retaining surface along the peripheral edge thereof forming a cavity for accepting the article, and a flange extending from a top edge of the wall surface to form a first mating surface, wherein the flange is formed with a female connecting surface portion and a male connecting surface portion symmetrically spaced apart from one another about a central axis through the first package portion. Also, the package includes an identically formed second package portion such that when the flange of the first package portion is positioned adjacent the flange of the second package portion, the male portions and the female portions can be aligned and removably connected to form an enclosure about the article.

12 Claims, 2 Drawing Sheets

DISPLAY PACKAGE

BACKGROUND OF THE INVENTION

1. Field of Invention

The present invention relates generally to the field of packaging and containers, and particularly to reclosable display packages formed from thin yet relatively rigid plastic material.

2. Description of the Prior Art

Display and presentation of merchandise are important aspects of retail marketing. Display packages must not only be suitable for the effective presentation and marketing of the merchandise, but the manufacture of the packages must e efficiently produces and be designed to be easily adaptable to standard fixtures as well as to minimize the labor required by the retailer or jobber to unpack and display the merchandise. Various types of reclosable display packages are currently used for packaging and displaying consumer articles. For example, a common plastic package is a "clam shell" type package. Clam shell type package include a front and a back cover which can hingedly connect and mate to one another at flange portions extending about the periphery thereof. The flange portions can include interlocking male and female portions and a tab for hanging the package. Such display packages are typically formed in a blister pack material, wherein a label or the like can be placed on or in the package in a visible manner. Prior hereto, the cost for producing suitable display packages of a two-part interconnecting clam shell type system had reached the point where the manufacture of these display packages is becoming prohibitive

SUMMARY OF THE INVENTION

The present invention solves the aforementioned and other problems of the prior art, and provides improved reclosable display package of thin relatively rigid material for displaying articles, and is well suited for displaying abrasive sheets and like articles having tendency to curl.

According to the invention, there is provided a reclosable display package of thin flexible thermoformed plastic material for packaging and displaying an article therein. The reclosable display package has a first package portion having a base with a retaining surface and a peripheral edge, a wall surface connected at a bottom edge extending generally upward from the retaining surface along the peripheral edge thereof forming a cavity for accepting the article, and a flange extending from a top edge of the wall surface to form a first mating surface. The flange is formed with a female connecting surface portion and a male connecting surface portion symmetrically spaced apart from one another about a central axis through the first package portion.

A second package portion is provided having a base with a retaining surface and a peripheral edge, a wall surface connected at a bottom edge extending generally upward from the retaining surface along the peripheral edge thereof forming a cavity for accepting the article, and a flange extending from a top edge of the wall surface to form a first mating surface, wherein the flange is formed with a female connecting surface portion and a male connecting surface portion symmetrically spaced apart from one another about a central axis through the first package portion. The female portions and the male portions of first package and the second package portion are complementary formed such that when the flange of the first package portion is positioned adjacent the flange of the second package portion, the male portions and the female portions can be aligned and removably connected to form an enclosure about the article.

Each of the package portions preferably includes a cut-out surface portion through which the article can easily be viewed when enclose in the reclosable package. The reclosable package further includes a tab portion by which the package may be hung on a display rack or similar device for displaying the packaged article.

The package portions are preferably identical in size and shape; therefore, both portions can be manufacture using the same mold. The reclosable package is assembled by securing the two mating surfaces together in a mirror image relationship such that the cavities of each the base portion provide a compartment for accepting the article(s) to be displayed. The mating edges are secured to each other in any conformable manner.

Preferably, the mating surfaces are provided with a plurality of locking cavities and a corresponding number of locking projections which snugly fit into the locking cavities to releasably lock the package portions together. The locking cavities and the locking projections are alternately space along the mating surfaces so that when the two base portions face each other, the locking cavities and the locking projections are in cooperating position wherein each cavity can accept a corresponding locking projection.

Therefore, it is an object of the present invention to provide a reclosable package for containing and displaying articles of manufacture.

It is another object of the invention to provide a reclosable package wherein the article(s) being displayed and the indicia relating to the particular article are easily viewed .

It is still another abject of the invention to simplify the reclosable package by providing two identical package portions, one of which is a rear package portion and the other is a front package portion wherein the two package portions are mated in a mirror image relationship to form the reclosable package.

It is yet another object of the invention to provide a relatively efficient and inexpensive reclosable package for displaying merchandise wherein the reclosable package is formed from a rear package portion and a front package portion wherein the rear portion and the front portion are identical allowing both rear and front portions to be easily and efficiently formed from the same mold.

These and other objects will be readily apparent from the following description when taken in conjunction with the accompanying drawings.

DESCRIPTION OF THE PREFERRED EMBODIMENT

Figures 1, 2:
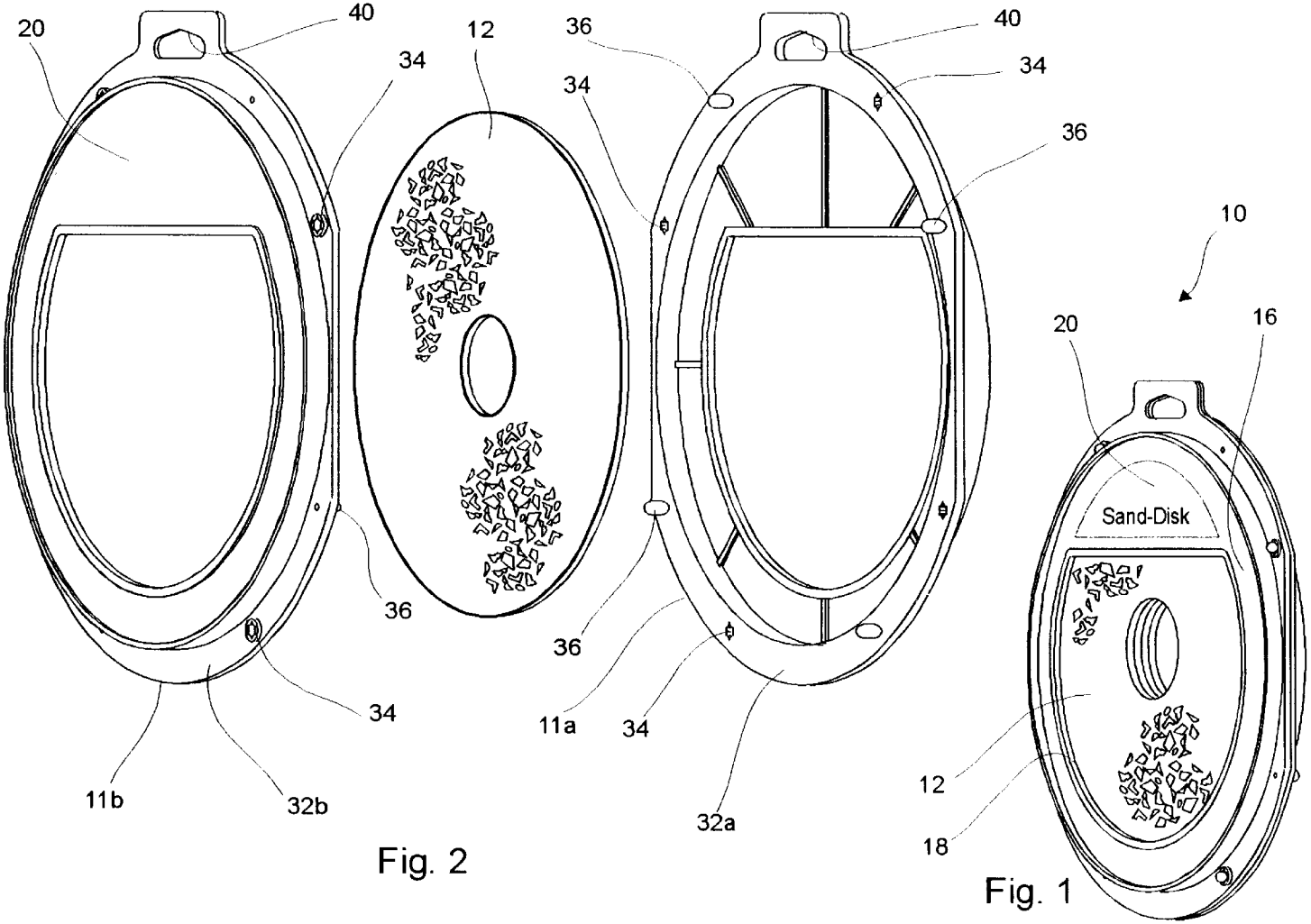
FIG. 1 is a perspective view of the present invention.
FIG. 2 is a perspective exploded view of the package portions of the present invention.

Referring to the drawings, a reclosable display package 10 is shown with an abrasive sheet material 12 housed therein. The package 10 is thermoformed from thin, flexible plastic material and includes a base 14 having a generally flat retaining surface 16.

Figure 4:
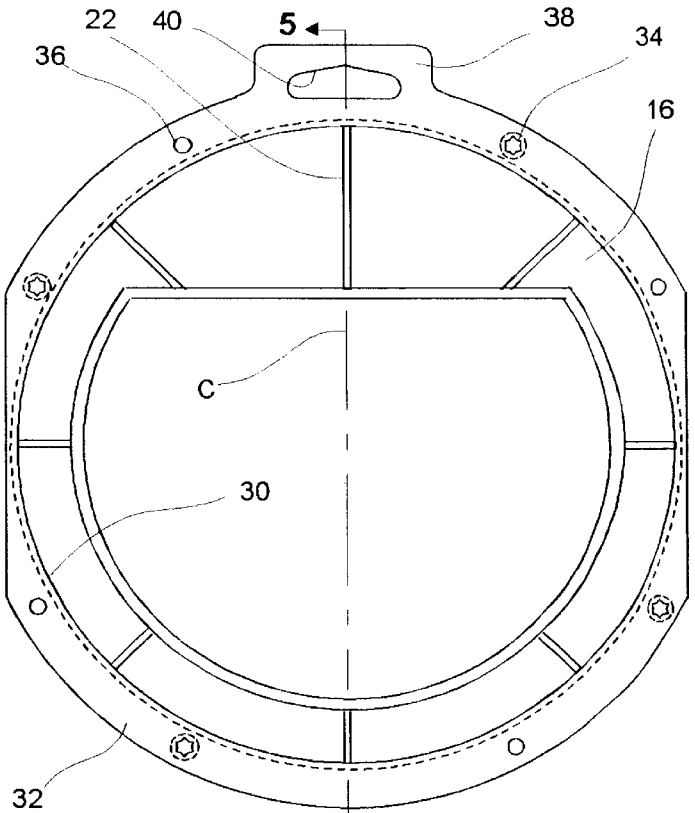
FIG. 4 is an inside view of the package portion of the present invention.
Figure 3:
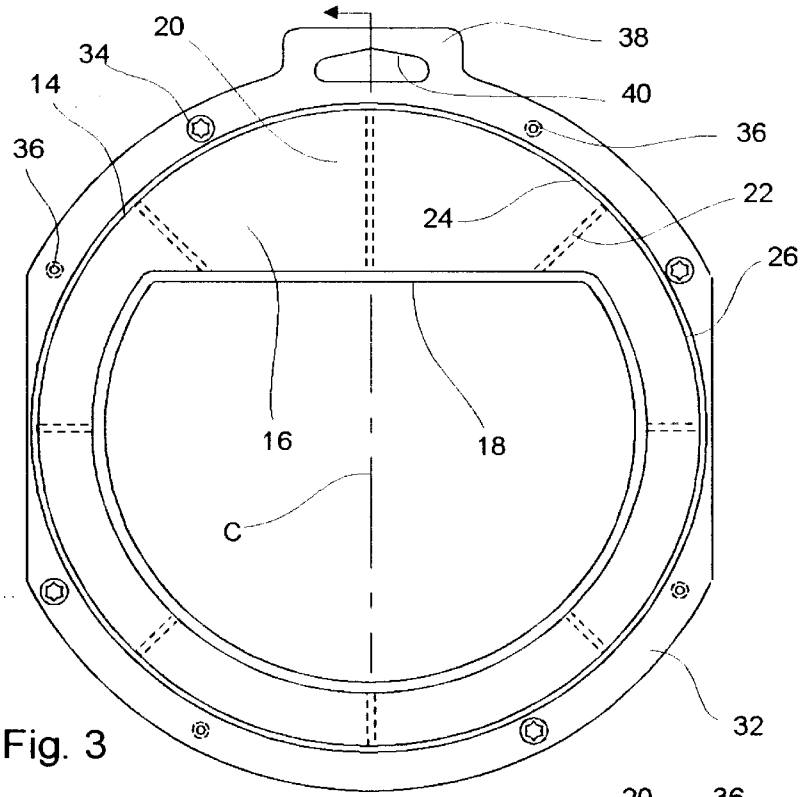
FIG. 3 is an outer view of the package portion of the present invention.
Figure 5:
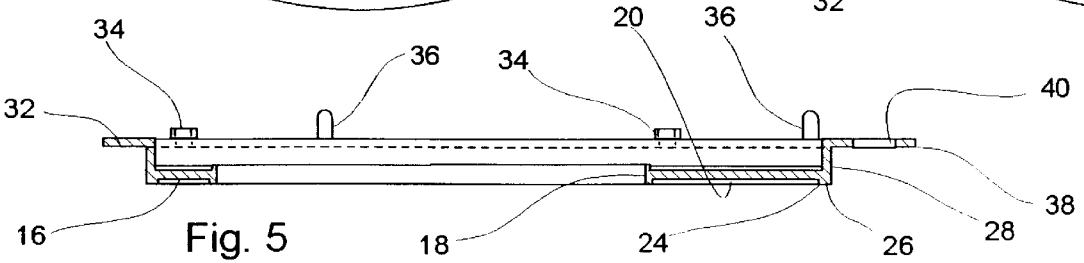
FIG. 5 is a cross-section of FIG. 4 through line 5—5.

The retaining surface 16 includes a cut-out surface portion 18 through which the abrasive sheets 12 can be seen. An enlarged portion 20 of the retaining surface 16 is provided for indicia to be printed thereon relating to the abrasive sheet material, for example. As seen on the inside view of FIG. 4, there are provided a plurality of ribs 22 which radially extend from the cut-out portion to a peripheral edge 24 of the retaining surface 16.

A bottom edge 26 of a wall 28 connects to the peripheral edge 24 and the wall 28 extends generally perpendicular to the retaining surface 16. A top edge 30 of the wall 28 connects to a flange 32 which in turn extends generally outward and perpendicular to the wall 28.

Formed on the flange 32 are a plurality of female connecting surface portions 34 and male connecting surface portions 36. Additionally, there is formed a tab 38 having an eyelet surface 40 therein to permit the package 10 to be hung on a hook or tung.

A central axis C is depicted as running centrally through the package 10 with half of the tab 38 on either side. The male connecting surface portions 36 and female connecting surface portions 34 are symmetrically spaced apart from one another about the central axis C on the flange 32. In this way, the female portions 34 and the male portions 36 are complementary formed such that when said flanges 32*a* and 32*b* of identically formed package portions 11*a* and 11*b*, respectively, are positioned adjacent one another, the male portions 36 and said female portions 34 can be aligned and removably connected to form an enclosure about the abrasive sheet 12.

Thus, the present invention provides a unique packaging device which is extremely well suited for containing and displaying abrasive sheets and other articles. The invention enables the sheets to be shown, yet maintains the sheets in a relatively flat position to prevent curl of the sheets, thereby reducing shelf space requirements. It is understood that the invention is not confined to the particular construction and arrangement herein illustrated and described, but embraces such modified forms thereof as come within the scope of the following claims.

What is claimed is:

1. A reclosable display package of thin flexible thermoformed plastic material for packaging and displaying an article therein, said reclosable display package comprises:

(a) a first package portion having a base with a retaining surface and a peripheral edge, a wall surface connected at a bottom edge extending generally upward from said retaining surface along the peripheral edge thereof forming a cavity for accepting said article, and a flange extending from a top edge of said wall surface to form a first mating surface, wherein said flange is formed with a female connecting surface portion and a male connecting portion symmetrically spaced apart from one another about a central axis through said first package portion; and (b) a second package portion having a base with a retaining surface and a peripheral edge, a wall surface connected at a bottom edge extending generally upward from said retaining surface along the peripheral edge thereof forming a cavity for accepting said article and a flange extending from a top edge of said wall surface to form a second mating surface, wherein said flange is formed with a female connecting surface portion and a male connecting portion symmetrically spaced apart from one another about a central axis through said first package portion, wherein said female portions and said -male portions of said first package portion and said second package portion are complementary formed such that when said flange forming said first mating surface of said first package portion is positioned adjacent Sad flange forming said second mating surface of said second package portion said male portions and said female portions can be aligned and removably connected to form an enclosure about said article, each said base having a cut-out portion in said retaining surface thereof for exposing said article.

2. The reclosable display package of claim 1, wherein said flange of each said base extends outwardly.

3. The reclosable display package of claim 1, wherein said retaining surface is provided with a plurality of rib surfaces thereon.

4. The reclosable display package of claim 3, wherein said cut-out surface is in said retaining surface and said rib surfaces extend radially from said cut-out surface to said peripheral edge.

5. The reclosable package of claim 1, wherein each said flange includes a tab having an eyelet formed therein and said eyelets align when said closure is formed.

6. The reclosable package of claim 1, wherein each said flange includes a plurality of said male portions and said female portions.

7. The reclosable display package of claim 6, wherein said male portions and female portions are alternately spaced apart on each said flange.

8. The reclosable package of claim 1, wherein said first package portion and said second package portion are formed from a substantially identical mold.

9. The reclosable package of claim 1, wherein said cavity is of a shape and size to retain sheets of abrasive material to prevent curl thereof.

10. The reclosable display package of claim 1, wherein each of said retaining surfaces is generally flat.

11. The reclosable display package of claim 1, wherein said retaining surface provides indicia relating to the article packaged therein.

12. The reclosable display package of claim 1, wherein said package is for displaying sheets of abrasive material.

* * * * *